US009304460B2

(12) United States Patent
Nemoto et al.

(10) Patent No.: US 9,304,460 B2
(45) Date of Patent: Apr. 5, 2016

(54) FIXING DEVICE AND IMAGE FORMING APPARATUS WITH FIXING DEVICE THAT ENSURE EFFECTIVE COOLING OF INDUCTION HEATING UNIT

(71) Applicant: Kyocera Document Solutions Inc., Osaka (JP)

(72) Inventors: Shinji Nemoto, Osaka (JP); Masahiko Fukano, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/681,110

(22) Filed: Apr. 8, 2015

(65) Prior Publication Data

US 2016/0011547 A1 Jan. 14, 2016

(30) Foreign Application Priority Data

Apr. 9, 2014 (JP) ..... 2014-080048

(51) Int. Cl.
*G03G 15/20* (2006.01)

(52) U.S. Cl.
CPC ..... *G03G 15/2053* (2013.01); *G03G 15/2017* (2013.01)

(58) Field of Classification Search
CPC ..... G03G 15/2053; G03G 15/2017
USPC ..... 399/69, 92, 122, 328, 329
See application file for complete search history.

(56) References Cited

U.S. PATENT DOCUMENTS

2009/0297204 A1* 12/2009 Kaji ..... 399/92

FOREIGN PATENT DOCUMENTS

JP 2009-139433 A 6/2009

* cited by examiner

*Primary Examiner* — Hoang Ngo
(74) *Attorney, Agent, or Firm* — James W. Judge

(57) ABSTRACT

A fixing device includes a housing, an induction heating unit, a first rotator, a second rotator, a shield member, an airflow generation unit, a cooling air path, and inlets. The shield member opposes the induction heating unit on a side thereof opposite from the first rotator. The airflow generation unit generates an airflow to cool the induction heating unit. The cooling air path is provided extending along the shield member on a side thereof opposite from the induction heating unit. The inlets open in the shield member, plurally arranged at intervals and paralleling the axis, for causing the airflow from the cooling air path to flow in toward the induction heating unit. The intervals between adjacent axially end-ward inlets are set narrower than the interval between axially central adjacent inlets.

12 Claims, 10 Drawing Sheets

FIXING DEVICE AND IMAGE FORMING APPARATUS WITH FIXING DEVICE THAT ENSURE EFFECTIVE COOLING OF INDUCTION HEATING UNIT

INCORPORATION BY REFERENCE

This application is based upon, and claims the benefit of priority from, corresponding Japanese Patent Application No. 2014-080048 filed in the Japan Patent Office on Apr. 9, 2014, the entire contents of which are incorporated herein by reference.

BACKGROUND

Unless otherwise indicated herein, the description in this section is not prior art to the claims in this application and is not admitted to be prior art by inclusion in this section.

An image forming apparatus such as a copier, a facsimile, and a printer includes an image forming unit, a transfer unit, and a fixing device. The image forming unit forms images on an image carrier (such as a photoreceptor drum). The transfer unit causes a toner image on the image carrier to be transferred onto a paper sheet as one example of a recording medium. The fixing device causes the toner images transferred onto the paper sheet to undergo heat fixing on the paper sheet.

As a fixing device, there is known a fixing device in which an electromagnetic induction heating (IH) method, which is capable of rapid heating and high efficiency heating, is employed. In the electromagnetic induction heating method, an induced current is induced on a fixing roller and a fixing belt due to magnetic flux generated by a high frequency current being flowed in an induction coil, thus heating the fixing roller and the fixing belt by Joule heat (induction heating). This Joule heat fixes the toner image on the paper sheet (recording medium).

In a fixing device of the electromagnetic induction heating method, there is known a technique that suppresses excessive temperature rise in a fixing belt and a fixing roller. This fixing device includes an inlet, to which airflow flows in, to cool an induction heating unit. Further, partial adjustment of a size of the inlet actively cools a high temperature region in the induction heating unit.

SUMMARY

A fixing device according to an aspect of the disclosure includes a housing, an induction heating unit, a first rotator, a second rotator, a shield member, an airflow generation unit, a cooling air path, and inlets. The induction heating unit is housed in the housing. The first rotator is rotationally driven and arranged opposing the induction heating unit, and inductively heated by the induction heating unit. The second rotator is rotationally driven and forms a nip area with the first rotator. The nip area is where toner-image carrying sheets pass. The shield member opposes the induction heating unit on a side thereof opposite from the first rotator. The shield member is provided extending in the direction of the axis on which the first rotator rotates. The airflow generation unit generates an airflow to cool the induction heating unit. The cooling air path is provided extending along the shield member on a side thereof opposite from the induction heating unit. The airflow passes through the cooling air path. The inlets open in the shield member, plurally arranged at intervals and paralleling the axis, for causing the airflow from the cooling air path to flow in toward the induction heating unit. Among the plurality of inlets, the intervals between adjacent axially end-ward inlets are set narrower than the interval between axially central adjacent inlets.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
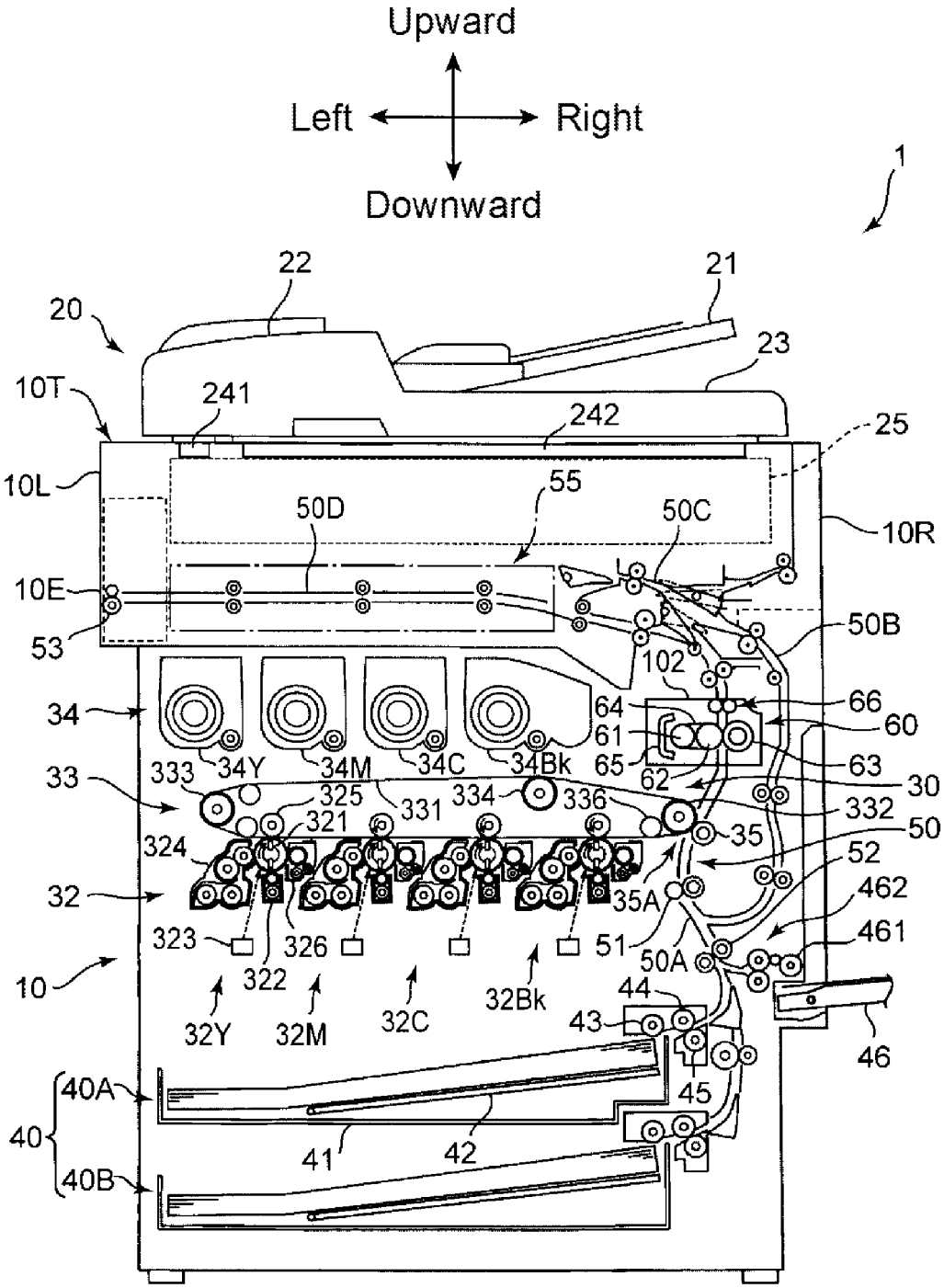
FIG. 1 illustrates a cross-sectional view of an internal structure of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an embodiment of the disclosure in detail based on drawings. FIG. 1 illustrates a cross-sectional view of an internal structure of an image forming apparatus 1 according to one embodiment of the disclosure. Here, although a copier is exemplified as the image forming apparatus 1, as long as an IH fixing method is employed, a printer, a facsimile device, or even a multi-functional peripheral including these functions may be applied.

The image forming apparatus 1 includes an apparatus main body 10 having an approximately rectangular-shaped housing structure, and an automatic document feeding unit 20 arranged on the apparatus main body 10. The following are housed inside the apparatus main body 10: a reading unit 25 optically for reading a document image to be copied, an image forming unit 30 for forming a toner image on a sheet, a fixing device 60 for causing the toner image to be fixed on the sheet, a paper sheet feeder 40 for retaining the sheet to be conveyed to the image forming unit 30, a conveying path 50 for conveying the sheet from the paper sheet feeder 40 up to a sheet discharge port 10E via the image forming unit 30 and the fixing device 60, and a conveyance unit 55 having a sheet conveyance path that constitutes a part of the conveying path 50 inside the conveyance unit 55.

The automatic document feeding unit 20 is turnably mounted on a top surface of the apparatus main body 10. The automatic document feeding unit 20 automatically feeds a document sheet to be copied toward a predetermined document reading position (which is a position where a first exposure glass 241 is mounted) in the apparatus main body 10. On the other hand, when a user places the document sheet by hand to a predetermined document reading position (which is an arrangement position of a second exposure glass 242), the automatic document feeding unit 20 is opened upward. The automatic document feeding unit 20 includes a document tray 21 on which the document sheet is placed, a document conveying unit 22 for conveying the document sheet via the automatic document reading position, and a document discharge tray 23 in which a read document sheet is discharged.

The reading unit 25 optically reads an image of the document sheet through: the first exposure glass 241 for reading of the document sheet automatically fed from the automatic document feeding unit 20 on the top surface of the apparatus main body 10, or the second exposure glass 242 for the reading of the hand-placed document sheet. The reading unit 25 includes: an imaging device, and a scanning mechanism having a light source, a moving carriage, a reflection mirror and a similar member, which are housed inside (not illustrated). The scanning mechanism irradiates light to the document sheet and guides the reflected light to the imaging device. The imaging device photoelectrically converts the reflected light into an analog electrical signal. The analog electrical signal is input to the image forming unit 30 after being converted to a digital electrical signal by an A/D conversion circuit.

The image forming unit 30 generates a full-color toner image and performs transfer processing of the full-color toner image onto a sheet. The image forming unit 30 includes an image forming unit 32, an intermediate transfer unit 33 (transfer unit) arranged adjacently on the image forming unit 32, and a toner replenishment unit 34 arranged on the intermediate transfer unit 33. The image forming unit 32 includes four units 32Y, 32M, 32C, and 32Bk that form respective toner images of yellow (Y), magenta (M), cyan (C) and black (Bk) arranged in a tandem.

The image forming units 32Y, 32M, 32C, 32Bk each include a photoreceptor drum 321 (image carrier) and a charger 322, an exposure device 323, a developing device 324, a primary transfer roller 325, and a cleaning apparatus 326 arranged in the peripheral area of the photoreceptor drum 321.

The photoreceptor drum 321 rotates around its shaft, and an electrostatic latent image and a toner image are formed on its circumference surface. The charger 322 uniformly electrically charges the surface of the photoreceptor drum 321. The exposure device 323 has a laser light source and optical system apparatuses such as a mirror and a lens. The exposure device 323 forms the electrostatic latent image on a circumference surface of the photoreceptor drum 321 by irradiating light based on an image data of the document image.

The developing device 324 supplies the circumference surface of the photoreceptor drum 321 with toner so as to develop the electrostatic latent image formed on the photoreceptor drum 321. The primary transfer roller 325 forms a nip area with the photoreceptor drum 321 by sandwiching an intermediate transfer belt 331 included in the intermediate transfer unit 33, so as to primarily transfer the toner image on the photoreceptor drum 321 onto the intermediate transfer belt 331. The cleaning apparatus 326, which has a cleaning roller and similar roller, cleans the circumference surface of the photoreceptor drum 321 after transfer of the toner image.

The intermediate transfer unit 33 includes the intermediate transfer belt 331, a drive roller 332, a driven roller 333, a tension roller 334, and a backup roller 336.

The intermediate transfer belt 331 is an endless belt bridged across these rollers 332, 333, 334, and 336, and the primary transfer roller 325. The intermediate transfer belt 331 has an outer peripheral surface on which the toner images from a plurality of photoreceptor drums 321 are transferred (primary transfer) and superimposed at the identical position.

A secondary transfer roller 35 is arranged facing a circumference surface of the drive roller 332. The secondary transfer roller 35 is also a conductive roller. A nip area formed by the drive roller 332 and the secondary transfer roller 35 becomes a secondary transfer unit 35A that transfers the full-color toner image superimposed on the intermediate transfer belt 331 to a sheet. A secondary transfer bias potential, which has the reversed polarity to the toner image, is applied to the secondary transfer roller 35, and the drive roller 332 is grounded.

The toner replenishment unit 34 includes a toner container for yellow 34Y, a toner container for magenta 34M, a toner container for cyan 34C, and a toner container for black 34Bk. These toner containers retain the toner of respective colors and supply the developing devices 324 of the image forming units 32Y, 32M, 32C, and 32Bk corresponding to the respective colors of YMCBk with the toner of the respective colors through a supply path (not illustrated).

The paper sheet feeder 40 includes two-tier sheet feed cassettes 40A and 40B, which house sheets to which image formation process is to be performed, and a sheet feed tray 46 for manual paper feeding. The sheet feed cassettes 40A and 40B can be pulled out forward from the front of the apparatus main body 10. The sheet feed cassettes 40A and 40B are cassettes located for automatic paper feed, and the sheet feed tray 46 for manual paper feeding is, in its lower end portion, openably/closably mounted with respect to the apparatus main body 10. A user opens the sheet feed tray 46 as illustrated in the drawing and places a sheet when performing manual paper feeding.

The sheet feed cassette 40A (40B) includes: a sheet housing portion 41 housing a sheet bundle in which a plurality of sheets are stacked, and a lift plate 42 for lifting up the sheet bundle for paper feeding. A pickup roller 43 and a roller pair of a feed roller 44 and a retard roller 45 are arranged in an upper portion of a right edge side of the sheet feed cassette 40A (40B). Driving the pickup roller 43 and the feed roller 44 feeds the sheet as an uppermost layer of the sheet bundle inside the sheet feed cassette 40A one by one, and the sheet is carried to an upstream end of the conveying path 50. On the other hand, the sheet placed in the sheet feed tray 46 is similarly carried in the conveying path 50 by the driving of a pickup roller 461 and a feed roller 462.

The conveying path 50 includes a main conveyance path 50A, an inverting conveyance path 50B, a reverse conveyance path 50C, and a horizontal conveyance path 50D. The main conveyance path 50A conveys the sheet from the paper sheet feeder 40 up to an outlet of the fixing device 60 via the image forming unit 30. The inverting conveyance path 50B returns the single-side printed sheet to the image forming unit 30 when performing duplex printing to the sheet. The reverse conveyance path 50C causes the sheet to head for the upstream end of the inverting conveyance path 50B from the downstream end of the main conveyance path 50A. The horizontal conveyance path 50D conveys the sheet in the horizontal direction from the downstream end of the main conveyance path 50A up to the sheet discharge port 10E located in a left side surface 10L of the apparatus main body 10. The horizontal conveyance path 50D is mostly constituted of sheet conveyance paths included inside the conveyance unit 55.

In an upstream side of the main conveyance path 50A, a registration roller pair 51 is arranged in the upstream side of the secondary transfer unit 35A. The sheet having been conveyed in the main conveyance path 50A hits the registration roller pair 51 in a halt state and halts once, and then skew correction is performed. Then the sheet is sent out to the secondary transfer unit 35A by the registration roller pair 51 being rotatably driven by a drive motor (not illustrated) at predetermined timing for image transfer. Further, a conveyance roller pair 52 for conveying the sheet is plurally arranged in the main conveyance path 50A. Other conveyance paths 50B, 50C, and 50D are similarly arranged.

In the most downstream end of the conveying path 50, a discharging roller pair 53 is adjacently arranged in a left side of the conveyance unit 55 in FIG. 1. The discharging roller pair 53 sends the sheet into an after-treatment unit (not illustrated), which is arranged to be connected to the apparatus main body 10, through the sheet discharge port 10E. Further, in the image forming apparatus where the after-treatment unit is not mounted, a sheet discharge tray is located below the sheet discharge port 10E.

The conveyance unit 55 is a unit that conveys the sheet carried out from the fixing device 60 up to the sheet discharge port 10E. In the image forming apparatus 1 of the embodiment, the fixing device 60 is arranged in a right side surface 1 OR side of the apparatus main body 10, and the sheet discharge port 10E is arranged in the left side surface 10L side of the apparatus main body 10 facing to the right-side surface 10R. Accordingly, the conveyance unit 55 conveys the sheet in the horizontal direction from the right side surface 10R of the apparatus main body 10 toward the left side surface 10L of the apparatus main body 10.

The fixing device 60 is a fixing device that employs an induction heating method, which performs a fixing process causing the toner image to be fixed on the sheet. The fixing device 60 includes a heating roller 61, a fixing roller 62, a pressure roller 63 (a second rotator), a fixing belt 64 (a first rotator), an induction heating unit 65, and a conveyance roller pair 66.

Figure 2:
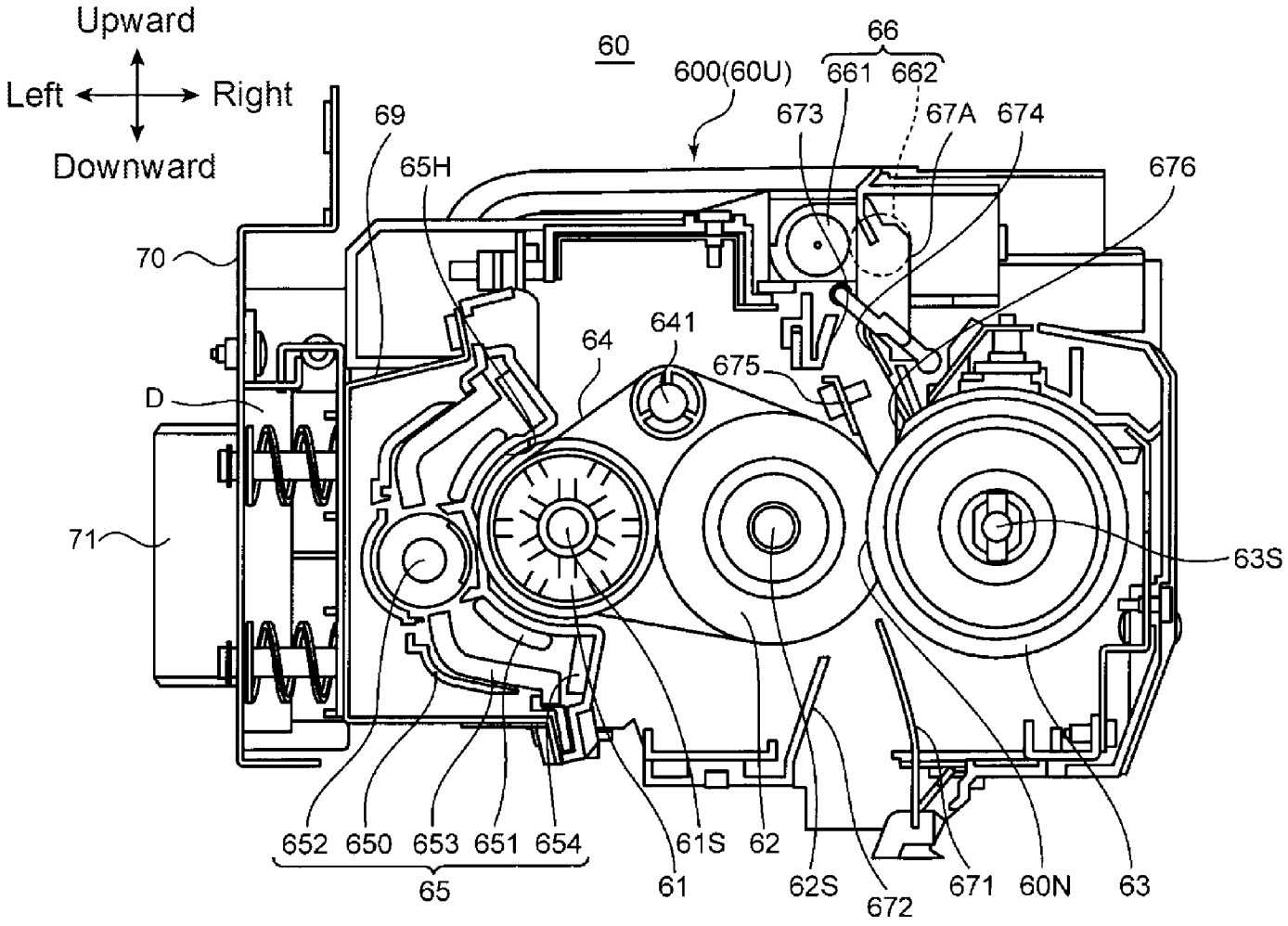
FIG. 2 illustrates a cross-sectional view of an internal structure of a fixing device according to the one embodiment.
Figure 3:
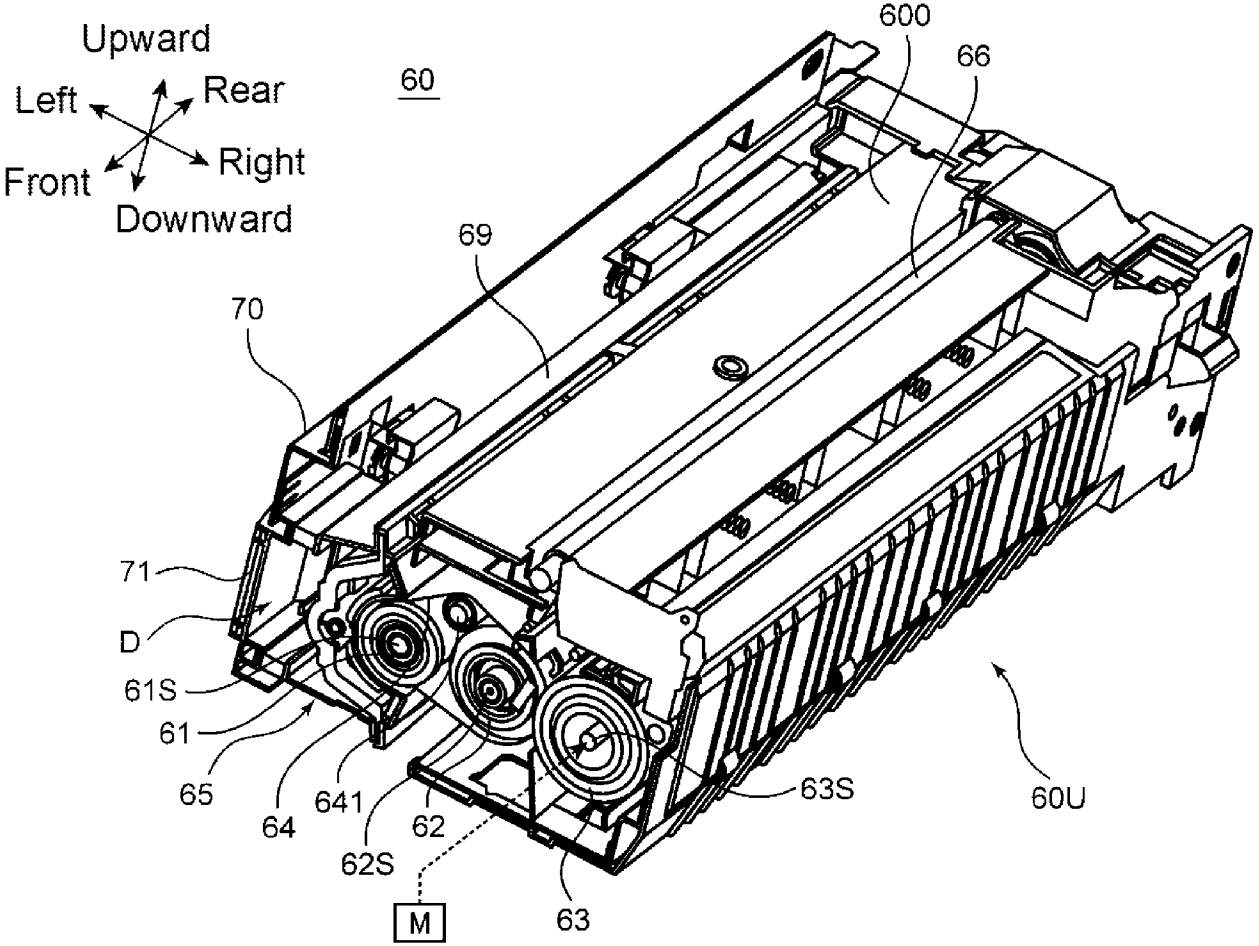
FIG. 3 perspectively illustrates a cross-sectional view of the fixing device according to the one embodiment.
Figure 4:
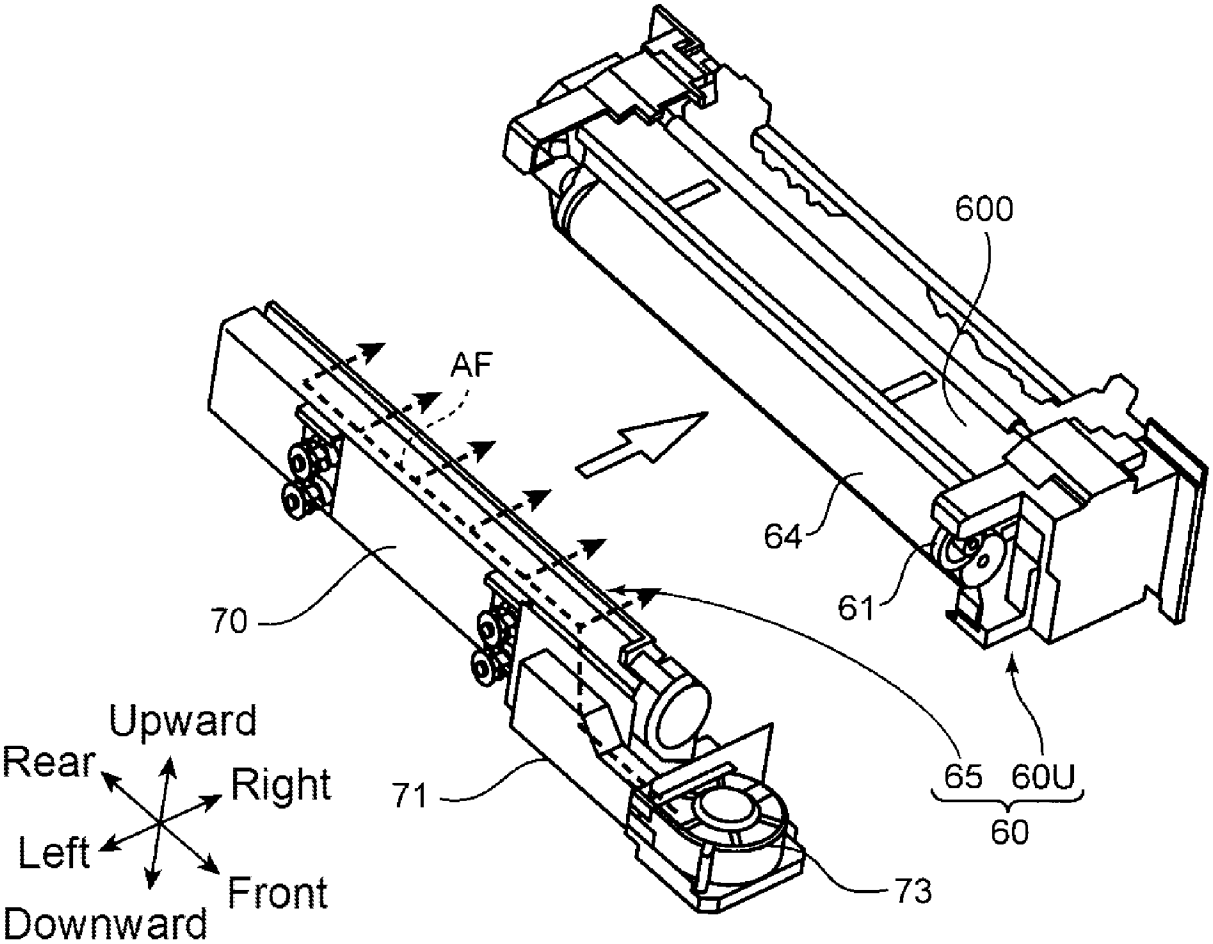
FIG. 4 illustrates a decomposed perspective view of the fixing device according to the one embodiment.

FIG. 2 illustrates a cross-sectional view of an internal structure of the fixing device 60. FIG. 3 illustrates a perspective cross-sectional view of the fixing device 60. FIG. 4 illustrates a decomposed perspective view of the fixing device 60 and its peripherals. The following describes the detail construction of the fixing device 60 based on FIGS. 2 to 4. The fixing device 60 is mounted to the apparatus main body 10 as a fixing unit 60U. The fixing unit 60U includes a housing 600. The housing 600 has a shape of an approximately rectangular cross-section and houses members for performing the fixing process.

The heating roller 61 is a roller inductively heated by the induction heating unit 65. The heating roller 61 is constituted of, for example, a magnetic metal such as iron, or stainless steel. The heating roller 61 has a surface on which a release layer, which is made of, for example, PFA. The heating roller 61 has a rotation shaft 61S and is rotationally driven around this rotation shaft 61S.

The fixing roller 62 and the pressure roller 63 are rollers with circumference surfaces brought into pressure contact sandwiching the fixing belt 64 to form a fixing nip area 60N. The sheet to which the toner image is secondarily transferred in the secondary transfer unit 35A undergoes heating and pressurization while passing through the fixing nip area 60N, while the toner image is fixed on the sheet surface.

The fixing roller 62 is an elastic roller with an elastic layer on a superficial layer. The elastic layer made of silicon sponge may be employed as the elastic layer. The fixing roller 62 has a rotation shaft 62S and is rotationally driven around the rotation shaft 62S.

The pressure roller 63 is a roller for forming the fixing nip area 60N with a predetermined width between the fixing roller 62 and the fixing belt 64 by application of pressure to the fixing roller 62. The sheet carrying the toner image on the surface undergoes the fixing process while passing through the fixing nip area 60N. One of a preferred constitution of the pressure roller 63 is a constitution including a metal core material such as iron or aluminum, a silicon rubber layer formed on the core material, and a fluororesin layer formed on the surface of the silicon rubber layer. The pressure roller 63 has a higher hardness in a superficial layer than a hardness in a superficial layer of the fixing roller 62 and includes a heating element such as a halogen heater inside the pressure roller 63. The pressure roller 63 has a rotation shaft 63S and is drivingly rotated around the rotation shaft 63S.

The fixing belt 64 is a belt that is suspended across the heating roller 61 and the fixing roller 62. The fixing belt 64 is rotated and inductively heated by the induction heating unit 65 similarly to the heating roller 61. The fixing belt 64 is arranged facing to the induction heating unit 65. In an inner circumference surface of the fixing belt 64, a tension roller 641 for providing this fixing belt 64 with tensile strength abuts on the inner circumference surface of the fixing belt 64. The fixing belt 64 is constituted in a manner that a silicon rubber elastic layer and a PFA release layer are sequentially formed on a substrate made of ferromagnetic material, for example, such as Nickel. Furthermore, when the fixing belt 64 is simply a carrier of heat emitted by the heating roller 61 without providing a heated function, a resin belt, such as polyimide (PI), may be employed.

As schematically illustrated in FIG. 3, rotary drive power is input to the rotation shaft 63S of the pressure roller 63 from a motor M (driving mechanism) included in the apparatus main body 10 side via a predetermined reduction gear mechanism. By rotation of the pressure roller 63, the heating roller 61, the fixing roller 62, the tension roller 641, and the fixing belt 64 are rotationally driven. As described above, the pressure roller 63 has a higher hardness than a higher hardness of the fixing roller 62. In view of this, the rotation shaft 63S of the pressure roller 63 is appropriate for driving input from the motor M in that fluctuation of a peripheral velocity of the outer periphery of the rotor does not occur during rotational driving.

The induction heating unit 65 is a unit for generation of heat required for the fixing process. The induction heating unit 65 includes an induction heating coil 651, a center core 652, core members with a plural pairs of arch cores 653 and one pair of side cores 654, a unit housing 650 housing these components. The induction heating unit 65 is housed in a left end portion of the housing 600. Additionally, the induction heating unit 65 is arranged facing with respect to the fixing belt 64 in the horizontal direction.

Figure 6:
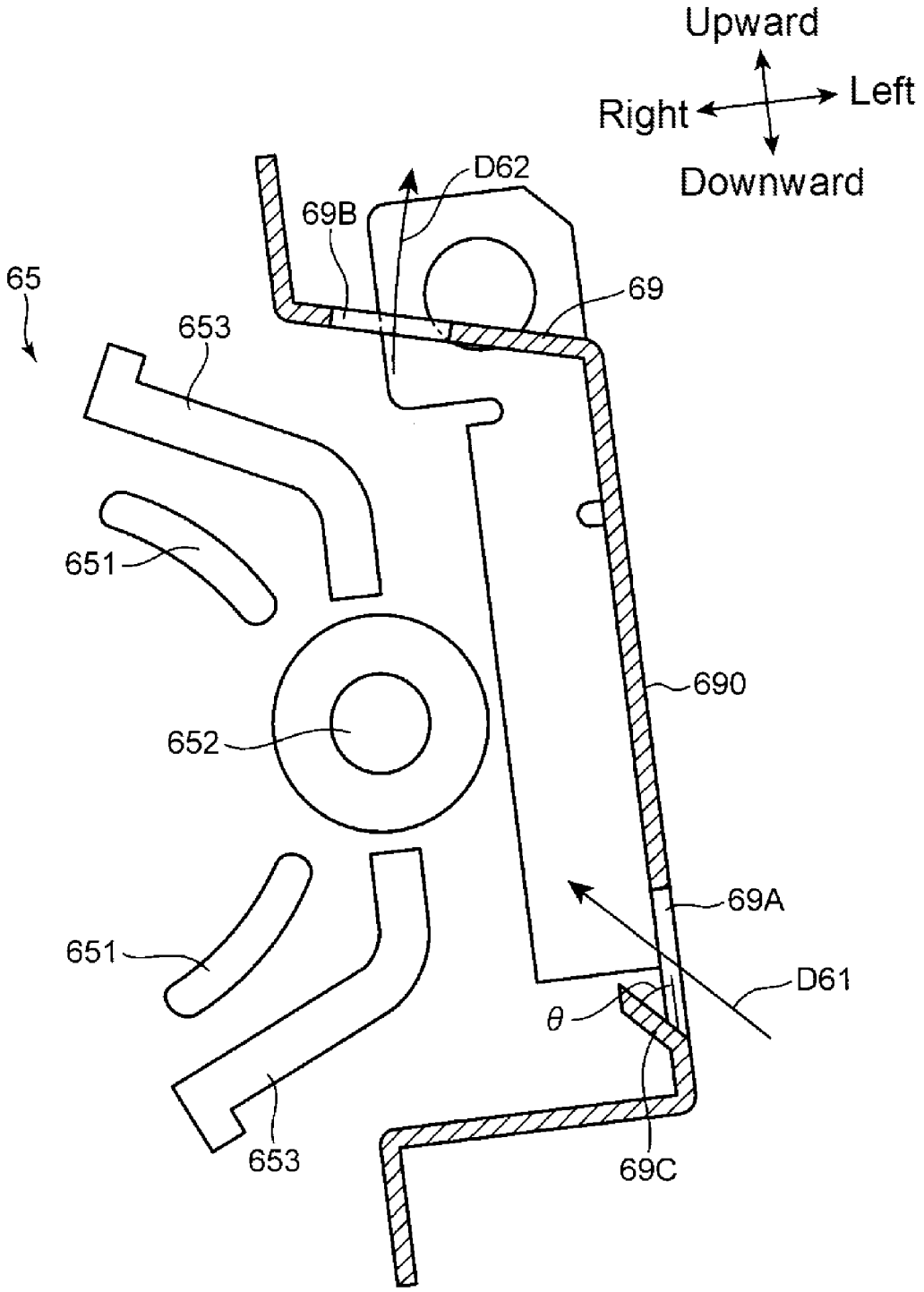
FIG. 6 illustrates a cross-sectional view of a periphery of the shield member of the fixing device according to the one embodiment.

The induction heating coil 651 generates magnetic flux for inductively heating the heating roller 61 and the fixing belt 64. The induction heating coil 651 is arranged on a virtual arc surface facing to an arc surface of the heating roller 61 and the fixing belt 64 in the cross-sectional view. The induction heating coil 651 is a winding wire wound in approximately elliptical shape in a side view viewed from the left side. The longitudinal direction in the winding of the induction heating coil 651 extends along the axial direction in the rotation of the fixing belt 64. The center core 652, the plural pairs of arch cores 653, and the one pair of side cores 654 are the core members made of ferrite, and are arranged so as to form a magnetic path passing through a part of the heating roller 61 and the fixing belt 64. The center core 652 is arranged so as to extend in the front-rear direction with a periphery of the center core 652 being surrounded by the induction heating coil 651. One pair of arch cores 653 is arranged so as to cover the induction heating coil 651 from the left side and sandwich the center core 652 in the vertical direction. Furthermore, the arch core 653 does not have a shape continuously extending in the front-rear direction, and a plurality of arch-shaped members illustrated in FIG. 2 and FIG. 6 are arranged at intervals in the front-rear direction. Thus, the induction heating coil 651 is partially exposed in the left side (in a shield 69 side described later) between the adjacent pair of arch cores 653. When the magnetic flux generated by the induction heating coil 651 passes through the magnetic path, eddy currents occur in the heating roller 61 and the fixing belt 64, and Joule heat is generated in association with the eddy currents.

The unit housing 650 is a housing member that holds the induction heating coil 651 and the core members. The unit housing 650 includes an arc-shaped concave portion 65H that a part of the heating roller 61 and the fixing belt 64 enter. The unit housing 650 of the induction heating unit 65 and a side surface (left side surface in FIG. 3) of the housing 600 of the fixing unit are fit in a positioned state. A predetermined gap is formed between an inner circumference surface of the concave portion 65H and a surface of the fixing belt 64.

With reference to FIG. 2, the conveyance roller pair 66 is a conveyance roller pair so as to send out the sheet having passed the fixing nip area 60N to the horizontal conveyance path 50D in a downstream side of the housing 600. The conveyance roller pair 66 includes a first conveyance roller 661 and a second conveyance roller 662, which are rotatably supported by the housing 600. The first conveyance roller 661 is a drive roller where rotary drive power is input from the apparatus main body 10 side, while the second conveyance roller 662 is a driven roller rotationally driven in association with rotation of the first conveyance roller 661. The second conveyance roller 662 is brought into pressure contact with the first conveyance roller 661 at a predetermined nip pressure so as to provide sheet conveying force.

One pair of guiding members 671 and 672, which guides the sheet carried in toward the fixing nip area 60N, is arranged in an upstream side of a sheet conveyance direction of the fixing nip area 60N. Further, one pair of guiding members 673 and 674, which guides the sheet discharged from the fixing nip area 60N toward the conveyance roller pair 66, is arranged in a downstream side in the sheet conveyance direction of the fixing nip area 60N. Furthermore, an actuator 67A for detection of passage of the sheet is swingably arranged in the downstream side in the sheet conveyance direction of the fixing nip area 60N.

In FIG. 2, the fixing roller 62 and the fixing belt 64 rotate in the counterclockwise direction, and the pressure roller 63 rotates in the clockwise direction. In the downstream side in the rotation direction with respect to the fixing nip area 60N, a separation plate 675 is arranged with respect to the circumference surface of the fixing belt 64, and a separation claw 676 is arranged with respect to the circumference surface of the pressure roller 63. The separation plate 675 and the separation claw 676 are arranged so as to take off the sheet attempting to wind around the circumference surface of the fixing belt 64 or the pressure roller 63. The separation plate 675 is a plate-shaped member extending in the axial direction of the fixing roller 62, and a minute space is located between a distal end portion of the separation plate 675 and the circumference surface of the fixing belt 64. On the other hand, the separation claw 676 is a member with a width of about several millimeters in the axial direction of the pressure roller 63, and a distal end of the separation claw 676 is brought in contact with the circumference surface of the pressure roller 63. Additionally, while the separation plate 675 is one sheet of plate member with a length corresponding to a paper passing width, the separation claw 676 is plurally arranged at a predetermined interval in the axial direction of the pressure roller 63.

With reference to FIG. 2 and FIG. 3, the shield 69 (shield member) is integrally mounted on a back surface of the unit housing 650. The shield 69 faces the induction heating unit 65 in the opposite side of the fixing belt 64 and is axially extended in the rotation of the fixing belt 64. The shield 69 prevents magnetic field generated at the induction heating unit 65 from leaking out of the fixing unit 60U. A main body frame 70 of the apparatus main body 10 is arranged in the back surface of the shield 69. The main body frame 70 is a sheet metal frame extended parallel to the shield 69 in the front-rear direction.

Between the main body frame 70 and the shield 69, a space D (cooling air path), through which cooling air (airflow) can pass, is provides. As illustrated in FIG. 4, a main body cooling duct 71 included in the apparatus main body 10 side is connected to a front-side end of the main body frame 70. A cooling fan 73 (airflow generation unit) is mounted to the main body cooling duct 71 in an upstream side of a flow path of the cooling air. The cooling fan 73 is a sirocco fan generating airflow cooling the induction heating unit 65. Driving the cooling fan 73 flows the cooling air into a front end side of the space D toward a rear direction. In other words, the space D is a wind path in which the cooling air flows and is extended along the shield 69 in the opposite side of the induction heating unit 65.

Figure 5:
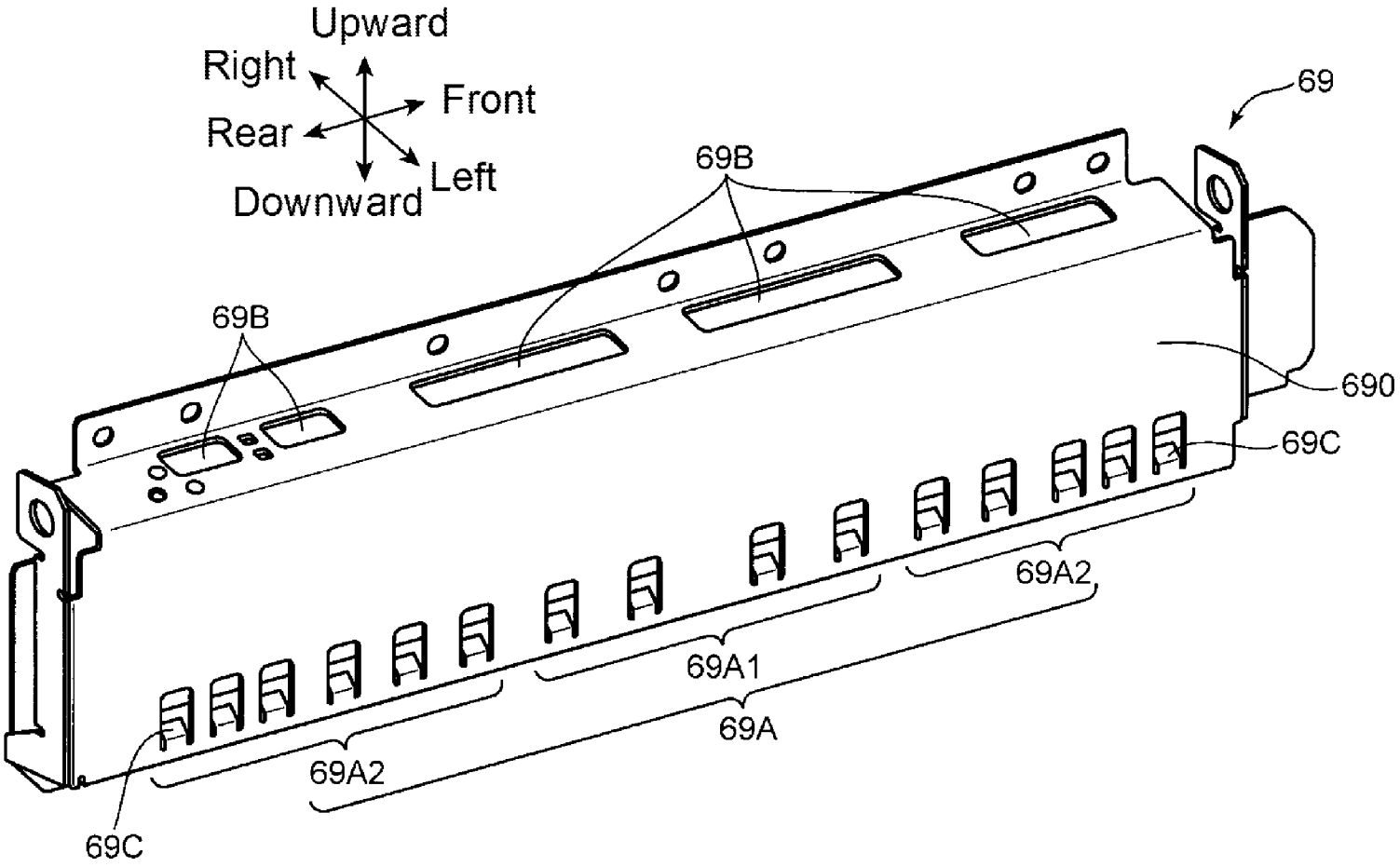
FIG. 5 perspectively illustrates a shield member of the fixing device according to the one embodiment.

Next, with reference to FIG. 5 and FIG. 6, the following further describes in detail about the shield 69 of the fixing device 60 according to the embodiment. FIG. 5 illustrates a perspective view of the shield 69 of the fixing device 60 according to the embodiment. FIG. 6 illustrates a cross-sectional view of the periphery of the shield 69 of the fixing device 60. FIG. 6 corresponds to a cross-sectional view intersecting with the axial direction in the rotation of the fixing belt 64.

With reference to FIG. 5, the shield 69 is constituted of a sheet metal member extended long in the front-rear direction with a predetermined height in the vertical direction. An upper end portion of the shield 69 is bent approximately 90 degrees rightward along the front-rear direction while a distal end side of the shield 69 is bent upward. Similarly, a lower end portion of the shield 69 is also bent approximately 90 degrees rightward along the front-rear direction while the distal end side of the shield 69 is bent downward. Accordingly, as illustrated in FIG. 6, the shield 69 has an approximately U shape in a cross-sectional view. Additionally, front-and-rear end edges of the shield 69 are also bent rightward. Accordingly, the shield 69 is arranged facing the induction heating unit 65 so as to surround the induction heating unit 65 (FIG. 6).

The shield 69 includes an opposite surface 690, an inlet 69A, an outlet 69B, and a bent portion 69C (cutout face). The opposite surface 690 is a surface extended along the vertical direction in the shield 69 and in the front-rear direction. The opposite surface 690 is arranged facing the induction heating unit 65. The inlet 69A is opened in the opposite surface 690 of the shield 69, and is plurally arranged at intervals along the axial direction (front-rear direction) in the rotation of the fixing belt 64. The inlet 69A is arranged in a lower end portion of the opposite surface 690. Additionally, the plurality of inlets 69A has approximately the identical size and shape. Accordingly, in the opposite surface 690, the other opening is not formed in the portion upper than the plurality of inlets 69A adjacent in the front-rear direction. The inlet 69A has a function of causing the cooling air to flow toward the induction heating unit 65 from the space D. The maximum range in which the plurality of inlets 69A distributes in the front-rear direction, that is, a width from a frontmost inlet 69A up to a rearmost inlet 69A is set to be larger than the maximum sheet width of a sheet passing through the fixing nip area 60N.

In the embodiment, the inlet 69A includes a first inlet 69A1 and a second inlet 69A2. The first inlet 69A1 is a plurality of inlets distributed in the center in the axial direction among the inlets 69A. The second inlet 69A2 is a plurality of inlets distributed in both the end portions in the axial direction among the inlets 69A. As illustrated in FIG. 5, an interval between an adjacent pair of second inlets 69A2 in the front-rear direction is set narrower than an interval between an adjacent pair of first inlets 69A1 in the front-rear direction.

The outlet 69B is an opening opened in an upper end side of the shield 69. In the embodiment, the outlet 69B is formed in a region facing upward in the shield 69. Similarly to the inlet 69A, the outlet 69B is also plurally arranged at intervals in the axial direction. The outlet 69B has a function causing the cooling air having passed the induction heating unit 65 to vent outside of the fixing device 60.

The bent portion 69C is a part of the opposite surface 690 for forming of the inlet 69A. That is, the inlets 69A are each formed as follows: the bent portion 69C is cut out in approximately a rectangular shape with one side left and is bent with the one side as a fulcrum. In the embodiment, the bent portion 69C is bent with a lower end edge as the fulcrum in the right side with respect to the opposite surface 690, that is, toward the induction heating unit 65 side. In this case, as illustrated in FIG. 6, an angle θ, by which the bent portion 69C is bent with respect to the opposite surface 690, is set to be 45 degrees.

When an image forming operation in the image forming apparatus 1 is started, the induction heating unit 65 heats the heating roller 61 and the fixing belt 64 by control signals output from a control unit (not illustrated). Further, the heating roller 61, the fixing roller 62, the pressure roller 63, and the fixing belt 64 are each rotated by the motor M (see FIG. 3). In this case, rotation of the cooling fan 73 flows the cooling air in the space D between the shield 69 and the main body frame 70. The cooling air is guided rearward along the space D (see FIG. 3 and FIG. 4). Furthermore, the cooling air flows inside the fixing unit 60U (see arrow D61 in FIG. 6) via the inlet 69A opened in the shield 69. Then, as illustrated in FIG. 6, the induction heating unit 65 arranged facing the shield 69 is cooled by the cooling air.

The sheets of various sizes pass through between the fixing belt 64 and the pressure roller 63. Especially, when small-sized sheets consecutively pass through the fixing nip area 60N, temperatures of the fixing belt 64 itself rise because the heat is not consumed from the fixing belt 64 in a non-paper passing region of both ends side in the axial direction, through which sheet surfaces do not pass. As a result, also in the induction heating unit 65 facing the fixing belt 64, temperatures at both the end portions in the axial direction easily rise (excessive temperature rise at the end portion). Even in such case, according to the embodiment, among the plurality of inlets 69A, the interval between the adjacent pair of second inlets 69A2 in the end portion in the axial direction is set narrower than the interval between the adjacent pair of first inlets 69A1 in the center in the axial direction. Accordingly, more cooling air flows into the induction heating unit 65 in the end portion in the axial direction compared with the center in the axial direction. As a result, the temperature distribution in the axial direction of the induction heating unit 65 can be uniformed. Furthermore, since an inflow amount of cooling air is adjusted by the intervals of the inlets 69A with approximately the identical size, leakage of the magnetic field from the induction heating unit 65 can be suppressed compared with the case where an opening area of the inlet 69A itself is significantly varied.

Additionally, in the embodiment, as illustrated in FIG. 6, the induction heating unit 65 and the opposite surface 690 of the shield 69 are arranged facing in the horizontal direction. Thus, the cooling air for cooling the induction heating unit 65 can be spouted to a lower portion of the induction heating unit 65 from the inlet 69A. Accordingly, the cooling air is easily guided upward as a rising airflow while cooling the induction heating unit 65, thus ensuring effective cooling of the upper portion of the induction heating unit 65. Then, the cooling air of the rising airflow is promptly exhausted from the induction heating unit 65 through the outlet 69B (see arrow D62 in FIG. 6). This ensures that new cooling air flows in from the inlet 69A again and effectively cools the induction heating unit 65.

Furthermore, in the embodiment, the inlet 69A is formed by the bent portion 69C being bent toward the induction heating unit 65 side with the lower end edge as the fulcrum. Thus, the bent portion 69C functions as a guiding member for guiding the cooling air to the induction heating unit 65 side (in FIG. 6). Additionally, the bent portion 69C prevents a disturbance of the flow of the cooling air heading for the induction heating unit 65 because the bent portion 69C defines the lower portion of the inlet 69A opened in the lower end portion of the opposite surface 690. Furthermore, the bent portion 69C is cut out by punch processing or similar processing and bent to easily form the inlet 69A.

The fixing device 60 according to the embodiment of the disclosure and the image forming apparatus 1 that includes the fixing device 60 have been described above. The disclosure is not limited to the embodiment and can be employed to, for example, a following modified embodiment.

(1) In the above-described embodiment, although the fixing unit 60U including the heating roller 61 and the fixing belt 64 is exemplified, a type of fixing unit in which the heating roller 61 and the fixing belt 64 do not exist may be employed. Specifically, it is constituted by a cylindrical-shape belt that is formed by a magnetic material similar to the fixing belt 64 and wound around the outer periphery of the fixing roller 62. In the modified embodiment, the induction heating unit 65 inductively heats the cylindrical-shape belt.

Figure 7A:
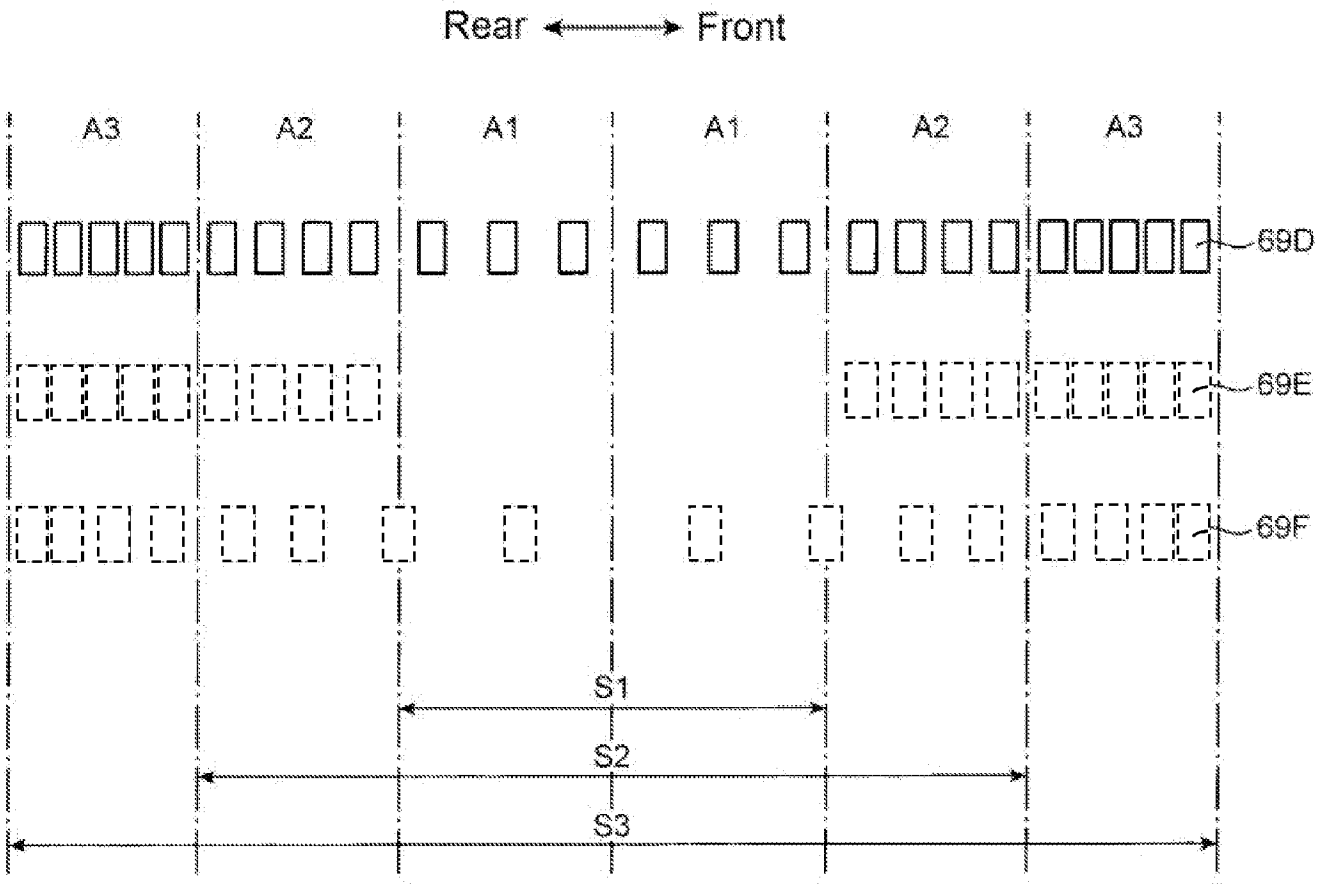
FIGS. 7A to 7C schematically illustrate distributions of inlets in shield members of fixing devices according to respective modified embodiments of the disclosure, wherein the inlet distribution of the given modified embodiment in each figure is shown in solid lines, and the inlet distributions of the other, related modified embodiments are indicated by hidden lines for comparison's sake.
Figure 7B:
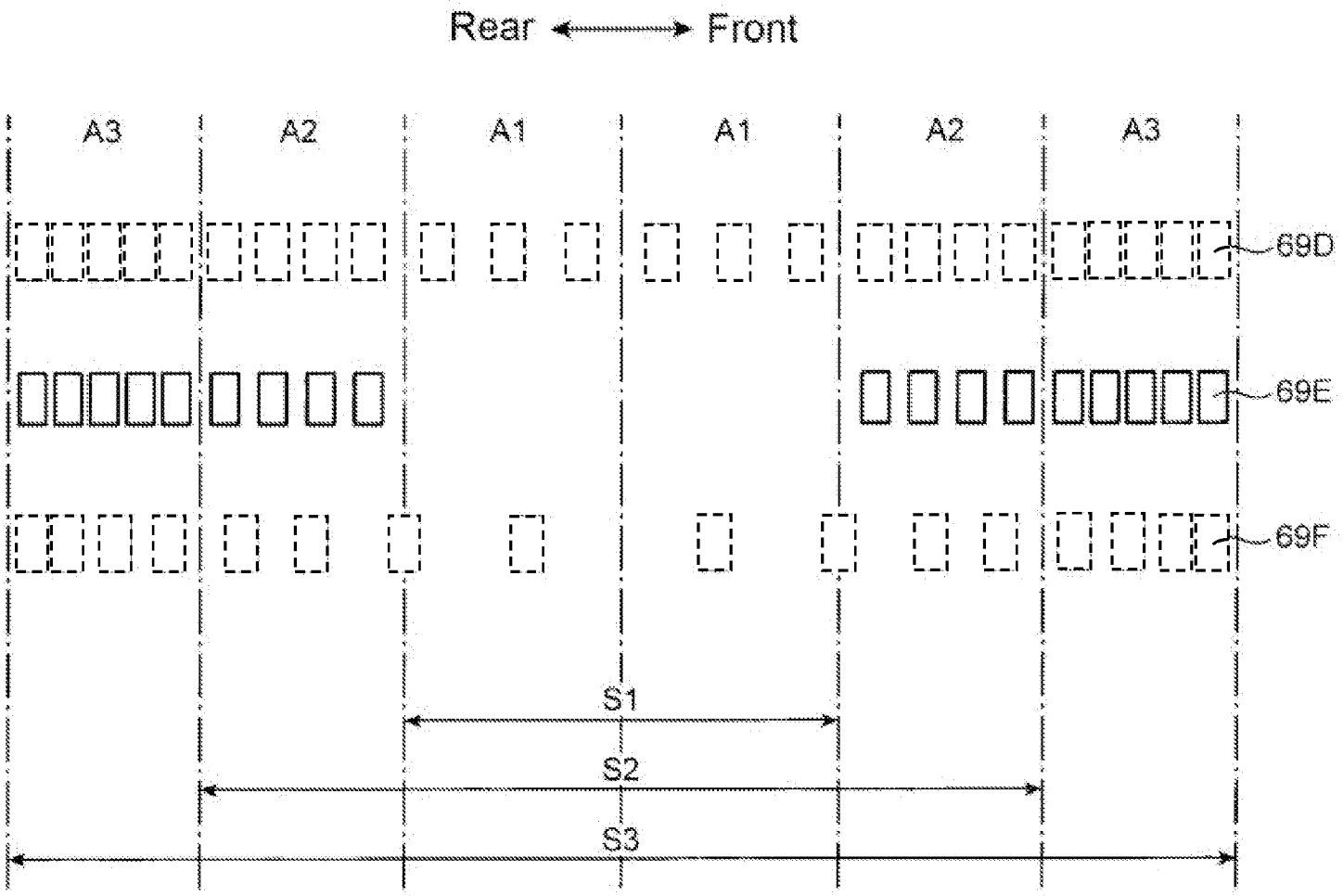
Figure 7C:
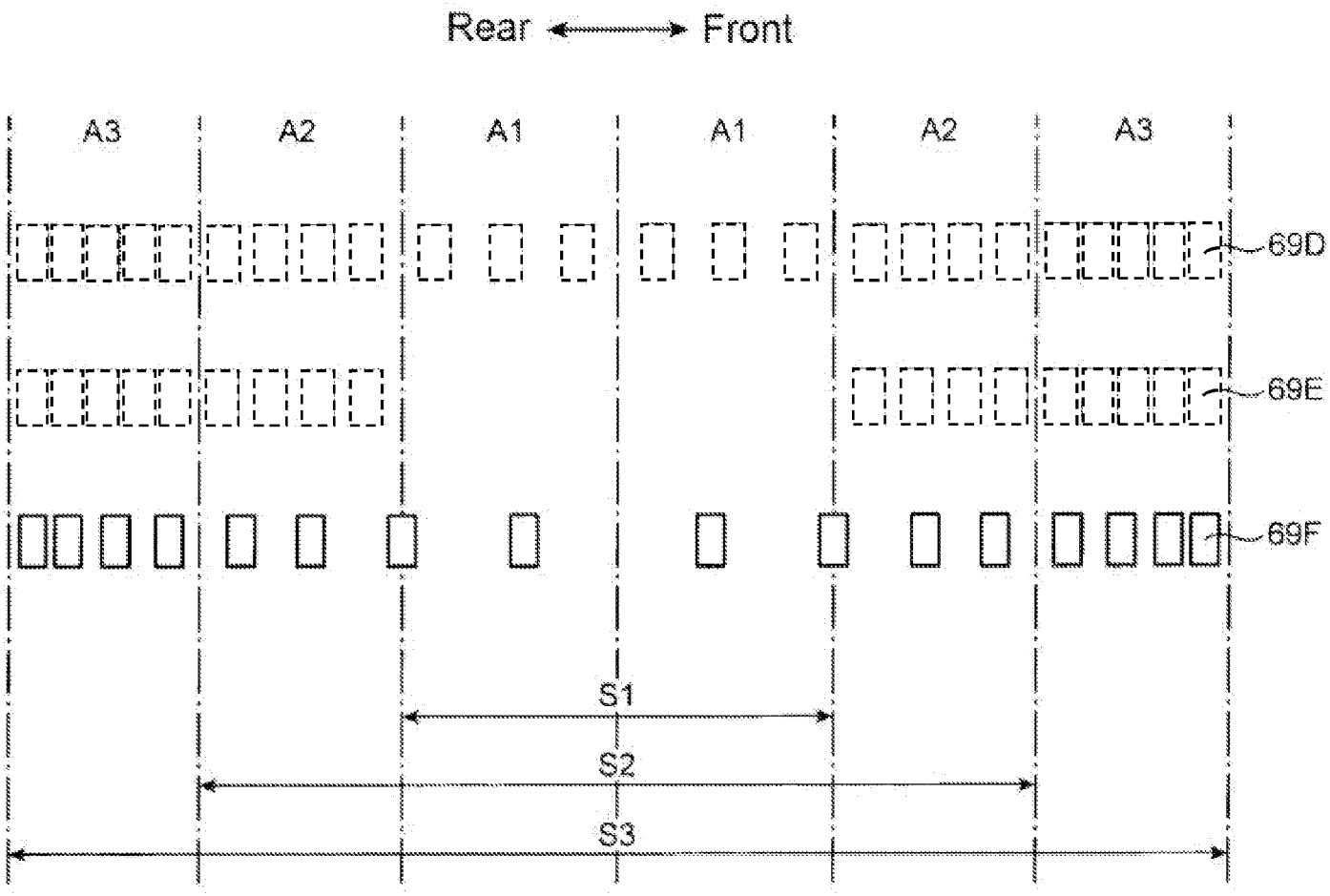

(2) In the above-described embodiment, although it has been described in a manner that the shield 69 includes the first inlets 69A1 and the second inlets 69A2 as the inlets 69A, the disclosure is not limited to the embodiment. FIGS. 7A to 7C illustrate schematic diagrams of distributions of inlets in shield members of fixing devices according to modified embodiments of the disclosure. In FIG. 7A, instead of the inlets 69A according to the previous embodiment, inlets 69D are formed distributed in the front-rear direction, with inlets 69E and 69F of below-described further modified embodiments, illustrated respectively in FIGS. 7B and 7C, indicated by hidden lines for comparison's sake. In the inlets 69D, intervals between adjacent pairs of inlets 69D in the axial direction (front-rear direction) decrease in stages from the center in the axial direction toward the end portion in the axial direction. That is, positioning in the front-rear direction of the sheet is regulated with reference to the center, and sheets S1, S2, and S3 of different sizes pass through the fixing nip area 60N (see FIG. 2). When the sheet S1 passes through the fixing nip area 60N, a region A1 in FIGS. 7A to 7C is the paper passing region and regions A2 and A3 are non-paper passing regions. Similarly, when the sheet S2 passes through the fixing nip area 60N, the regions A1 and A2 in FIGS. 7A to 7C are the paper passing regions and the region A3 is the non-paper passing region. Further, when the sheet S3 passes through the fixing nip area 60N, all of the regions A1, A2, and A3 in FIGS. 7A to 7C are the paper passing region. Additionally, in the inlets 69D in FIG. 7A, the intervals between the adjacent pairs of inlets 69D are set narrowly in the order of the regions A1, A2, and A3. Accordingly, a flow rate of the cooling air flowing in the induction heating unit 65 can be varied in stages in the axial direction. Then, also in such constitution, both the end portions of the induction heating unit 65, which is facing to the regions A2 and A3 likely to be the non-paper passing region, can be actively cooled. Furthermore, the intervals between the adjacent pairs of inlets 69D in the axial direction are set in stages corresponding to a sheet width of different sizes of sheets passing through the fixing nip area 60N. Accordingly, temperature distribution of the induction heating unit 65 in the axial direction can be more uniformed.

Similarly, in inlets 69E in FIG. 7B, the inlets 69E are not formed in the region A1 compared with the inlets 69D in FIG. 7A, indicated by hidden lines in FIG. 7B. The region A1 is constantly the paper passing region, and the heat of the fixing belt 64 is consumed by the sheet. Even in such constitution, both the end portions of the induction heating unit 65, which is facing to the regions A2 and A3, can be actively cooled. Additionally, in inlets 69F in FIG. 7C, intervals between adjacent pairs of inlets 69F in the axial direction consecutively decrease from the center in the axial direction toward then end portion in the axial direction. In this case, the flow rate of the cooling air flowing in the induction heating unit 65 can be consecutively varied in the axial direction. Then, both the end portions of the induction heating unit 65, which is facing to the regions A2 and A3, can be actively cooled.

(3) Further, in the above-described embodiment, as illustrated in FIG. 6, although it has been described in a manner that the angle θ, by which the bent portion 69C is bent with respect to the opposite surface 690, is set to be 45 degrees, the disclosure is not limited to this. An angle, by which the bent portion 69C is bent with respect to the opposite surface 690 in the end portion in the axial direction, may be set larger than an angle by which the bent portion 69C is bent with respect to the opposite surface 690 in the center in the axial direction. In this case, in both the end portions in the axial direction, the cooling air flowing in through the inlet 69A is actively flowed in toward the induction heating unit 65. On the other hand, in the center in the axial direction, the cooling air flowing in through the inlet 69A is exhausted through the outlet 69B passing through a space between the center core 652 and the opposite surface 690. Even in such constitution, the temperature distribution of the induction heating unit 65 in the axial direction is uniformly maintained.

Figure 8:
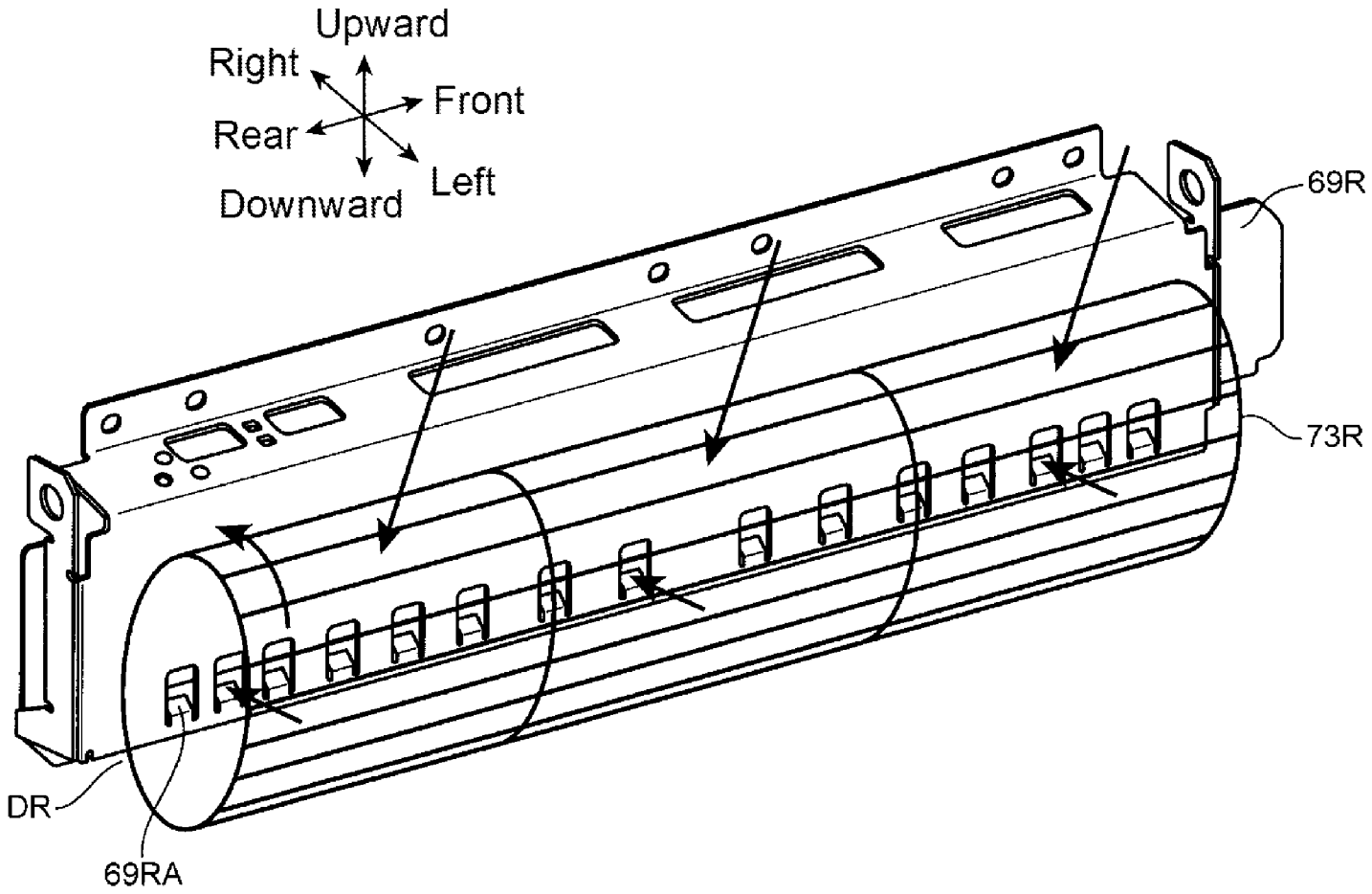
FIG. 8 perspectively illustrates a shield member and an airflow generation unit of the fixing device according to the modified embodiment of the disclosure.

(4) Further, in the above-described embodiment, it has been described in an aspect where the cooling fan 73 as the airflow generation unit is the sirocco fan. In this case, the cooling air can be flowed in from one end side of the space D (cooling air path). Accordingly, a size of the fixing device 60 in a direction intersecting with the axial direction is reduced. Additionally, the disclosure is not limited to this. FIG. 8 illustrates a perspective view of a shield 69R (shield member) and a cooling fan 73R (airflow generation unit) of a fixing device according to a modified embodiment of the disclosure. In the modified embodiment, the cooling fan 73R is a cross-flow fan, which is arranged facing to a space DR (cooling air path) along the axial direction (front-rear direction) and flows the cooling air (airflow) into the space DR from the direction intersecting with the axial direction. In such case, the size of the fixing device in the axial direction is reduced, and a flow rate of the cooling air, which is capable of flowing into an inlet 69RA along the axial direction, is stably ensured.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A fixing device, comprising:

a housing;

an induction heating unit housed in the housing;

a rotationally driven first rotator arranged opposing the induction heating unit, and inductively heated by the induction heating unit;

a rotationally driven second rotator forming a nip area with the first rotator, the nip area being where toner-image carrying sheets pass;

a shield member opposing the induction heating unit on a side thereof opposite from the first rotator, the shield member being provided extending in the direction of the axis on which the first rotator rotates;

an airflow generation unit that generates an airflow to cool the induction heating unit;

a cooling air path provided extending along the shield member on a side thereof opposite from the induction heating unit, wherein the airflow passes through the cooling air path; and inlets opening in the shield member, plurally arranged at intervals and paralleling the axis, for causing the airflow from the cooling air path to flow in toward the induction heating unit, wherein among the plurality of inlets, the intervals between adjacent axially end-ward inlets are set narrower than the interval between axially central adjacent inlets.

2. The fixing device according to claim 1, wherein the axial intervals between adjacent inlets consecutively decrease heading from the central area toward the end portions axially.

3. The fixing device according to claim 1, wherein the axial intervals between adjacent inlets decrease in stages heading from the central area toward the end portions axially.

4. The fixing device according to claim 3, wherein the axial intervals between adjacent inlets are set in stages corresponding to sheet widths of different sizes of sheets passing through the nip area.

5. The fixing device according to claim 1, wherein:

the shield member includes an opposing surface facing the induction heating unit; and the inlet is formed by a cutout face being a portion of the opposing surface, from which the cutout face is cut leaving one side, and bent over on the one side as a fulcrum.

6. The fixing device according to claim 5, wherein:

the induction heating unit and the first rotator are arranged opposing each other along a horizontal direction;

the opposing surface of the shield member is provided extending vertically;

the plurality of inlets is arranged along a lower-end side of the opposing surface; and the inlet is formed by the cutout face being bent toward the induction heating unit with a lower-end edge of the cutout face as the fulcrum.

7. The fixing device according to claim 6, wherein an angle to which the cutout face is bent with respect to the opposing surface at the end portions axially is larger than an angle to which the cutout face is bent with respect to the opposing surface in the central area axially.

8. The fixing device according to claim 1, wherein:

the induction heating unit and the first rotator are arranged opposing each other along a horizontal direction;

the shield member is provided extending vertically; and the plurality of inlets is arranged along a lower-end side of the shield member.

9. The fixing device according to claim 8, further comprising an outlet opening in a upper-end side of the shield member, for venting airflow having passed the induction heating unit.

10. The fixing device according to claim 1, wherein the airflow generation unit is a sirocco fan that causes the airflow to flow into the cooling air path from alongside one axial end of the cooling air path.

11. The fixing device according to claim 1, wherein the airflow generation unit is a cross-flow fan arranged opposing the cooling air path, paralleling the axis, for causing the airflow to flow into the cooling air path from a direction intersecting the axis.

12. An image forming apparatus, comprising:

an image carrier having a surface on which a toner image is formed;

a transfer unit that transfers the toner image onto a sheet; and the fixing device according to claim 1.

* * * * *